US005789695A

United States Patent [19]

Scherer et al.

[11] Patent Number: 5,789,695

[45] Date of Patent: Aug. 4, 1998

[54] METHOD AND APPARATUS FOR DISASSEMBLING AND REASSEMBLING PROJECTILES

[76] Inventors: Werner Scherer, Moselufer 7, D54338 Schweich; Walter Hanser, Rebgaessle 5, D75189 Bad Krotzingen, both of Germany

[21] Appl. No.: 648,281

[22] Filed: May 15, 1996

[30] Foreign Application Priority Data

May 15, 1995 [DE] Germany ..... 195 17 760.6

[51] Int. Cl.[6] ..... F42B 33/06

[52] U.S. Cl. ..... 86/49; 86/20.1; 86/50; 86/1.1

[58] Field of Search ..... 86/1.1, 20.1, 20.14, 86/49, 50; 102/393, 489

[56] References Cited

U.S. PATENT DOCUMENTS

| | | | |
|---|---|---|---|
| 3,229,561 | 1/1966 | Jones et al. | 86/49 |
| 4,253,375 | 3/1981 | Field | 86/1.1 |
| 5,353,676 | 10/1994 | King et al. | 86/50 |

FOREIGN PATENT DOCUMENTS

| | | | |
|---|---|---|---|
| 481874 | 4/1992 | European Pat. Off. | 102/489 |
| 3434878 | 4/1986 | Germany | 102/489 |

*Primary Examiner*—Harold J. Tudor
*Attorney, Agent, or Firm*—Hill, Steadman & Simpson

[57] ABSTRACT

A method and apparatus are provided for dismantling and reassembling projectiles which contain a plurality of safety-activatable bomblets in one or more cluster layers. The method and apparatus are particularly useful for disassembling bomblets from a projectile of a first caliber, and loading the bomblets into a projectile of a second caliber. In the first projectile having its casing and components disassembled uncovers an uppermost bomblet layer. The bomblet layer is seated against a first transport cover configured to correspond to a positional pattern for those bomblets of the projectile being disassembled. The bomblet layer is pneumatically held against the first transport cover. A bottom cover is detachably secured to the first transport cover under the bomblet layer, and the fuse of each bomblet is secured. This forms a safe container for moving the bomblets. The individual bomblets are them removed, and least some may be arranged on a second transport cover fashioned according to another positional pattern corresponding to a second projectile to be assembled. That bomblet layer is lowered into the second projectile casing as the lowermost bomblet layer. The above steps are repeated until either the lowermost bomblet layer is removed from the first projectile or until an uppermost bomblet layer is introduced into the projectile to be assembled.

16 Claims, 4 Drawing Sheets

METHOD AND APPARATUS FOR DISASSEMBLING AND REASSEMBLING PROJECTILES

BACKGROUND OF THE INVENTION

The present invention is directed to a method and apparatus for disassembling and reassembling projectiles of a type which contain a plurality of bomblets arranged in one or more layers and which have a fuse safety means. More specifically, the present invention relates to a method and apparatus whereby the bomblets from a projectile of a first caliber to be disassembled are reassembled into a projectile of a second caliber.

Generally, bomblet projectiles are artillery projectiles which carry a charge of submunition, such as daughter projectiles or bomblets. In use, these bomblets are ejected from the projectile casing by an ejector charge initiated by time fuses. This usually occurs at the bottom side, where rated break points of a structural shell floor fastening must be overcome. The bomblets, which produce a shrapnel formation in a beehive effect, thereby automatically release from their union or cluster. Each bomblet is respectively equipped with its own fuse that is armed by torsion and aerodynamic influence after releasing from the union. Bomblet fuses usually have a trigger system wherein an inert mass provides a needed initial energy. The reliable function thereby assumes a retardation of a bomblet which proceeds sufficiently fast upon impact onto a target that is soft and yielding such as snow, foliage or ground cover. In order to assure functional reliability, bomblet fuses have highly sensitive trigger elements.

As mentioned above, torsional and aerodynamic effects are utilized for arming bomblet fuses. Due to the small size of the bomblets, they contain no additional securing or arming mechanism such as a timer. Consequently, a bomblet fuse of an uncovered bomblet includes only a safety having a trigger with a very low-level threshold.

While the bomblets are loaded in the projectile, a further safety is achieved in that the compact arrangement due to positive lock, makes an arming of the fuse impossible even during failure of the above-described safety.

The reassembling of projectiles is advantageous for a number of purposes since the bomblet types are essentially identical among various projectiles. For example, the bomblets could be interchanged among projectiles of different calibers. Due to the described sensitivity of the trigger systems and the presence of only one safety after undoing the union, the disassembling of bomblet projectiles involves substantial safety risks.

Therefore, an object of the present invention is to provide a method for disassembling projectiles with minimal risks and hazards.

SUMMARY OF THE INVENTION

This object is achieved by the present invention, which inventively provides a method of safely dismantling a projectile so that its layers of bomblets are removed. Then, the method provides for reassembling a second projectile, placing at least some of those removed bomblets in layers in a second projectile. The method is particularly useful for exchanging bomblets from a dismantled projectile having a first caliber, and then loading at least some of the bomblets in a reassembled projectile having a second caliber. The invention also includes an apparatus for carrying out the prescribed method.

To these ends, the invention includes providing a prepared projectile of a first caliber from which components have been removed to expose an uppermost bomblet layer. Note that in a projectile having only one bomblet layer, the bomblet layer is both the uppermost and lowermost layer. This uppermost bomblet layer is carefully seated against a first transport cover. This first transport cover is configured according to the positional pattern of the bomblets of that projectile, which is to be disassembled. The bomblets are pneumatically held against the first transport cover by a vacuum, and the bomblet layer is thereby removed from the projectile casing.

A detachably securable bottom cover is placed under the removed bomblet layer and is locked onto the first transport cover. The fuse of each bomblet is then disabled by a safety means, such as by inserting a safety pin to disarm the bomblet. The locked-together bottom and transport covers then provide a safe container for moving the bomblet layer. Subsequently, the covers are separated so that the individual bomblets may be removed or marshalled into singles.

At least some of the removed bomblets are then arranged on a second transport cover which is configured according to a positional pattern corresponding to a lowermost bomblet layer arrangement of a second projectile which is to be assembled. This layer of bomblets is pneumatically held against the second transport cover. A second bottom cover is placed under the bomblet layer and is detachably secured to the second transport cover for safe conveying of the bomblet layer. The bomblet layer is lowered into the projectile casing of the second projectile, and the above-described steps are repeated until either the lowermost bomblet layer is removed from the first projectile or an uppermost bomblet layer is introduced into the second projectile.

For safety reasons, a determination should be made to see whether the fuse of every bomblet is secured before the removal of an uncovered bomblet layer from the projectile to be disassembled. This determination can be made via a television camera in order to eliminate risk to human personnel. Also, at some point in the process, the safety means are undone to re-enable the bomblet fuses in the second projectile.

Preferably, the pneumatic holding of the bomblet layers at the first or second transport cover is performed by a vacuum in communication with the bomblets through openings in the transport cover.

It is especially preferred that an opening is provided for each bomblet at each of the transport covers. This allows fuse pins to be inserted through the respective openings into each bomblet to block the respective trigger mechanisms.

An advantage of the present method and apparatus is to permit the transport cover to be turned by 180° when the bomblet layer is held fast.

The invention also advantageously provides for the disposal of individual extra bomblets which are not required for the re-equipping of projectiles to be assembled. To that end, the trigger housing that activates the detonator is broken off of each extra bomblet, a bead location fixing a beehive funnel is milled out, the explosive is removed, the ignition intensifier is ejected, the bomblet housing is washed out and, finally, the explosive, ignition intensifier and detonator are burned.

In the apparatus for disassembling projectiles according to the present invention, the first transport cover has a seating region for the bomblet layer according to a first positional pattern in the projectile to be disassembled. Similarly, the second transport cover has a seating region corresponding to a bomblet layer configuration with the second positional pattern of the projectile to be assembled. These seating regions of the transport covers are formed to have nesting recesses which correspond to the respective bomblet positions. The bomblets are cooperatively received partially within the respective nesting recesses so that the transport cover seats against the bomblets in a sealed, airtight manner.

The apparatus also includes a hydraulic feed mechanism, for example a hydraulic piston/cylinder arrangement, which advances or retracts the bomblet cluster or union relative to the projectile casing. This displacement positions the bomblets in a suitable position for removal from or installation in the projectile casing.

According to an advantageous embodiment, the transport cover includes openings through which an underpressure or vacuum can be applied to the seating region. The underpressure or vacuum is produced by a suction manipulator which provides the means for at least temporarily holding the bomblet layer seated against the respective transport cover. The suction manipulator communicates with the nesting recess through openings in the transport cover located respectively at each nesting recess.

It is especially advantageous when these openings are configured so that a safety pin for securing the respective bomblet can be respectively conducted through them.

Additional features and advantages are described in, and will be apparent from, the detailed description of the preferred embodiments and from the drawings.

DETAILED DESCRIPTION OF THE PREFERRED EMBODIMENTS

Bomblet projectiles, also referred to as grenade ejector projectiles, include a plurality of bomblets arranged within a projectile casing in at least one layer. An uppermost layer of bomblets arranged at a floor side is equipped with metal cups, each being shaped to cooperatively receive a bomblet for securing the bomblets in a cluster or union. A projectile head is screwed to the projectile casing. This screwed connection is usually additionally secured with an adhesive. A mouth canister with an ejector charge is inserted into a mouth of the projectile head. During storage and transport, a lifter ring closure screw is screwed into a thread in the mouth.

In order to disassemble such a projectile, the mouth closure screw must be unscrewed and the ejector charge must be removed. This may ensue in a conventional manner. An aluminum give may then be unscrewed. The interface must be heated, preferably to temperatures below 80° C., in order to avoid thread milling. It is recommendable to first unscrew the thread and trickle a suitable mixture of solvent and spirits into the thread gap. The thread can be completely released after an appropriate acting time has passed.

The bottom plate is then removed from the remaining projectile. A considerable exertion force is needed for unscrewing the screwed connection, and an appropriate apparatus must be provided having adequate clamp and drive force. In any case, the forces must be applied torsionally or rotationally to avoid any radial deformation of the projectile casing.

Subsequently, the opened projectile is introduced into an apparatus which provides a means to dismantle the bomblet union or cluster layer-by-layer from an uppermost layer down to a lowermost layer. In a projectile having only one layer, that layer is both the uppermost and lowermost layer. The apparatus displaces the layers in the direction of the bottom opening by applying a force to an expulsion plate attached at a head side. The expulsion force is preferably hydraulically applied. In such a hydraulic embodiment, a low-frequency pulsation with low amplitude assists in overcoming initial resistance.

The aforementioned metal cups which secure together the union or cluster are then removed. At this point, the first bomblet layer is thus uncovered at the fuse side.

For safety reasons, a determination should now be made, preferably with an image processing system or remote video system, to see whether one of the fuses of the bomblet has become armed. When the secured, unarmed condition has been verified, the bomblet layer can be removed from the shell casing.

Figure 1:
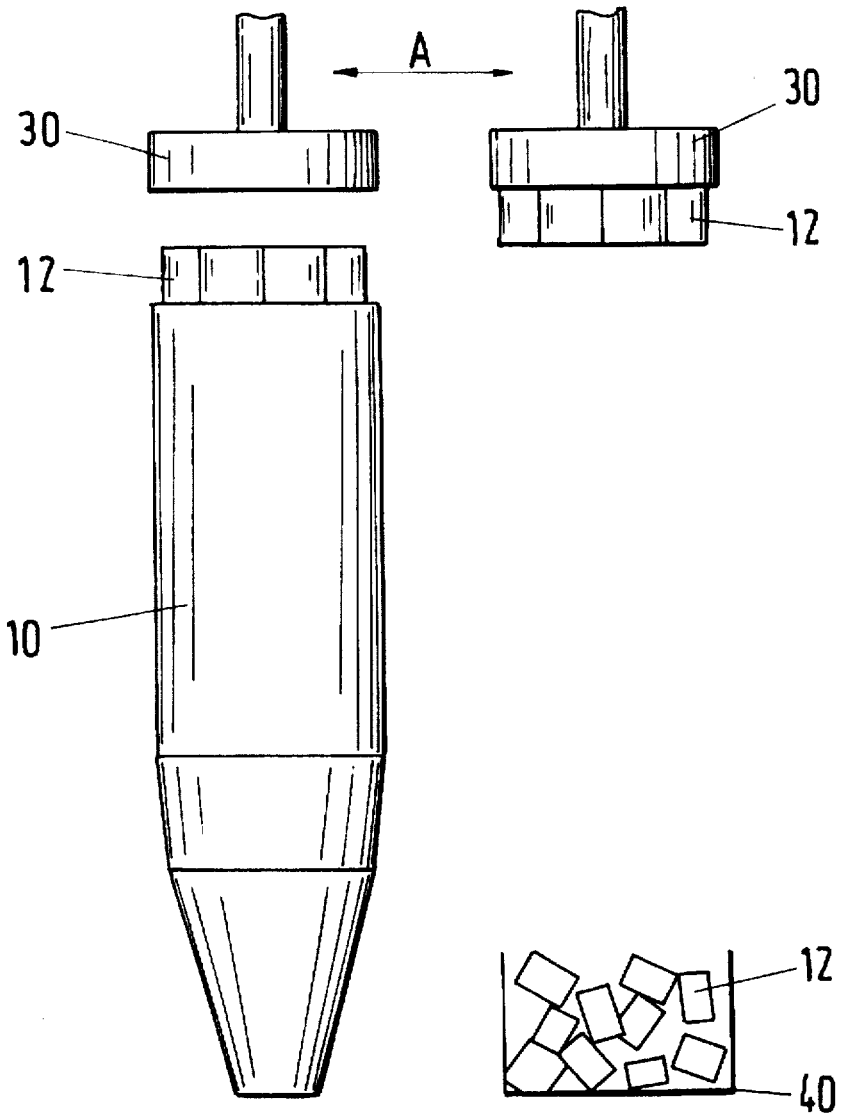
FIG. 1 is a side elevation of a first station for disassembling projectiles for the implementation of the method of the present invention.

FIG. 1 shows a bomblet-equipped projectile casing 10 from which the bottom plate has already been removed. A plurality of metal cups 12 for securing the first bomblet layer are uncovered and can be taken off with a suction lifter 30. The suction lifter 30 can thereby be pivoted aside, as indicated by the double arrow A, so that the suction lifter can deposit the metal cups 12 into a container 40.

Figure 2:
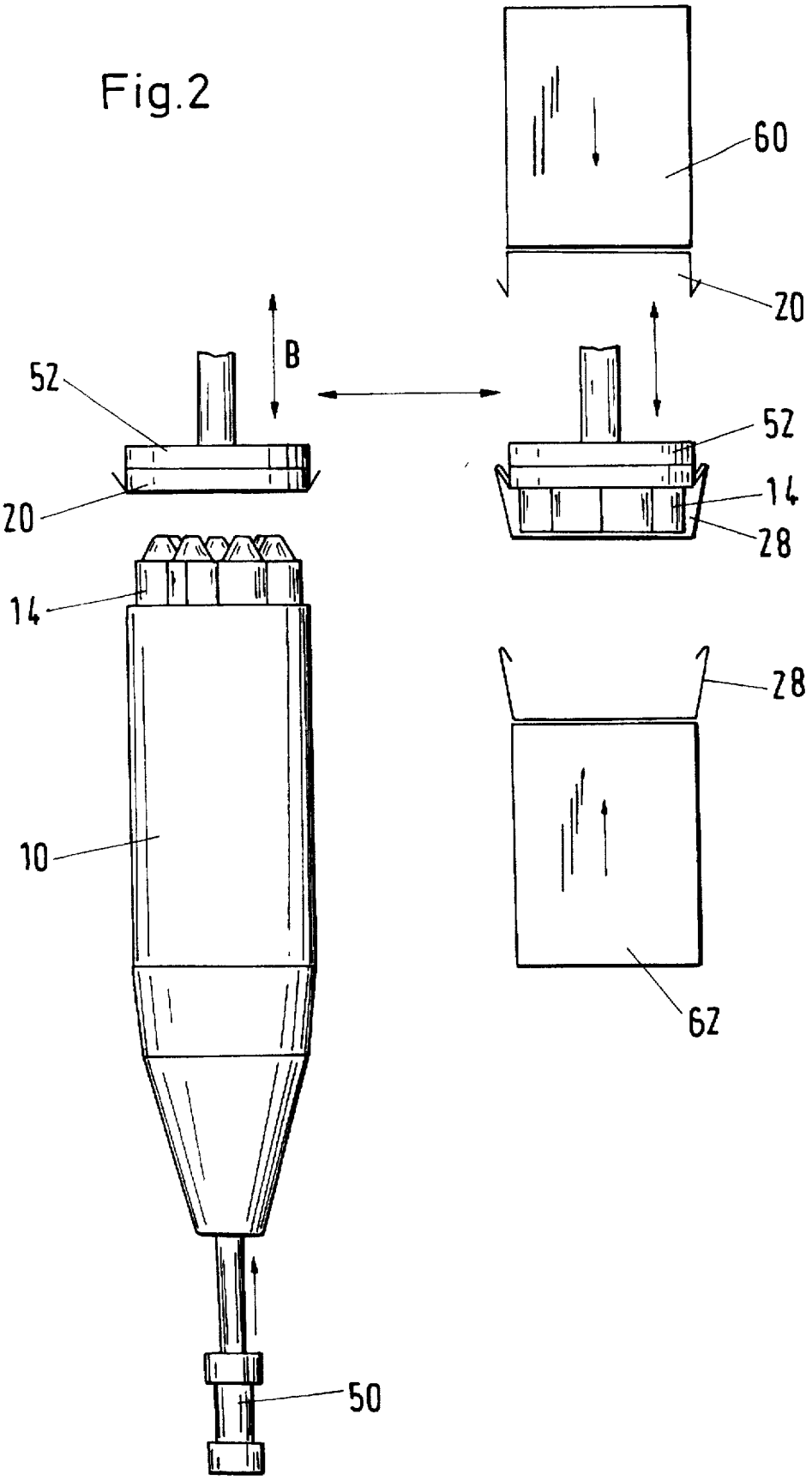
FIG. 2 is a side elevation of a second station for reassembling projectiles according to the method of the present invention.

FIG. 2 schematically shows the procedure for removing a bomblet layer 14 from the projectile casing 10. To that end, a hydraulic feed device 50 is applied from the side proceeding from the projectile head, moving the entire bomblet compact in the direction of the bottom opening of the projectile casing 10 until the first bomblet layer 14 lies free. A transport cover 20 (described in greater detail below in conjunction with FIG. 3) is taken from a magazine for transport covers and is held at a suction manipulator 52. The suction manipulator 52 and transport cover 20 are then moved over the first bomblet layer and lowered until the bomblet layer is seated against the transport cover 20. The bomblets of the bomblet layer 14 are then pneumatically held against the transport cover 20 by the vacuum of the suction manipulator 52. A bottom cover 28 is then taken from a magazine for bottom covers and is placed under the bomblet layer 14. This bottom cover is connected to the transport cover 20 with a positive lock, such as a snap closure or other suitable connection. The positively-locked bottom cover 28 and transport cover 20 thus form a secure container which provides the same safety when the bomblets were installed in the bomblet projectile, permitting safe handling and transport.

Figure 3:
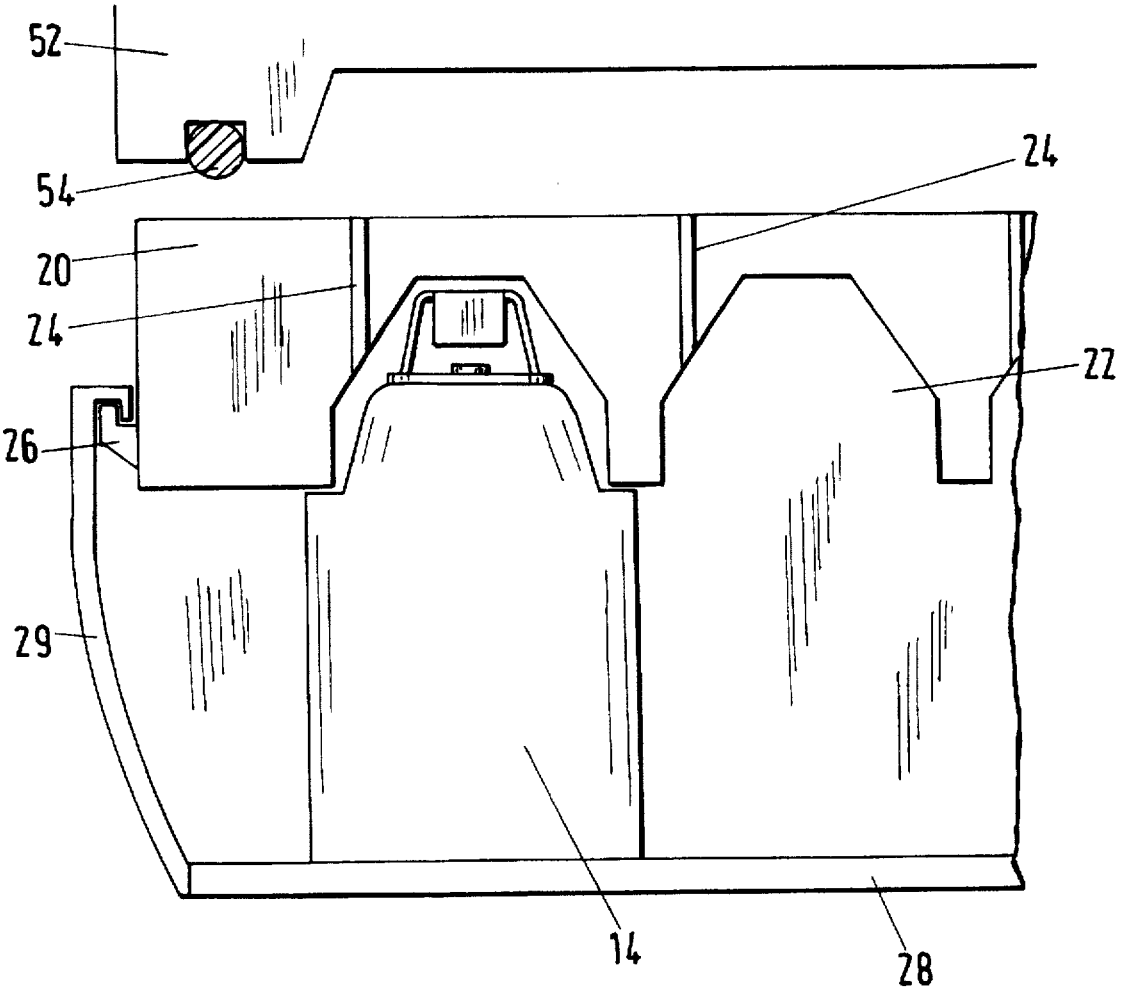
FIG. 3 is an enlarged fragmentary sectional view of a transport cover a bomblet layer of a projectile to be disassembled.

In a detailed view of the bomblet layer 14 and of the transport cover 20, FIG. 3 shows how a union safety for the bomblet layer 14 is achieved. The transport cover 20 is formed with a plurality of nesting recesses 22 into which each bomblet of the bomblet layer is respectively received at the fuse side (only one bomblet is shown in the FIG. 3). At a side of the transport cover 20 facing toward the suction manipulator 52, each nesting recess 22 is provided with an opening 24 arranged at the nesting recess 22 such that a safety pin for the fuse mechanism of a bomblet can be introduced through the opening.

The suction manipulator 52 presses against the transport cover 20 via a seal 54, so that a space that communicates with all bores 24 remains free between suction manipulator and transport cover 20. A vacuum is applied to this space so that a vacuum is formed in the nesting recess, holding the corresponding bomblet therein. To this end, the nesting recess 22 is fashioned such at its edge side that it forms a necessarily airtight seating surface or seating edge with the corresponding bomblet. The bomblet layer 14 in common with the transport cover 20 can thus be removed from the projectile casing by the suction manipulator 52.

A bottom cover 28 that engages with a closure clip 29 over a projection provided at the transport cover 20 is located under the bomblet layer 14. The suction manipulator 52 can then be removed from the transport cover 20, so that the bores 24 are exposed and the safety pin for each bomblet can be introduced through these bores 24. Transport cover 20 and bottom cover 28 can then be separated from one another risk-free, so that the bomblet layer 14 is exposed and the bomblets can be isolated from one another. The disassembling procedure for one bomblet layer is thus completed.

Fundamentally, the above-described procedure could be repeated until all bomblet layers have been removed from the first projectile casing. An empty projectile casing of a second projectile, for example one of a different caliber, may then be loaded with the bomblets simultaneously or subsequently. Accordingly, the detached bomblets are introduced into a second transport cover having basically the same structure as the transport cover 20, whereby a nesting recess 22 with bore 24 is again provided for each bomblet. In the second transport cover, however, a positional pattern of the nesting recesses 22 and the corresponding bomblets is selected to match the casing of the projectile to be assembled. Detached bomblets, equipped with safety pins, are placed into transport covers according to the different bomblet arrangement and are secured by attaching a corresponding bottom cover, allowing the safety pins to be removed to re-enable the fuses.

A suction manipulator 52 then picks up the transport cover again, and the bottom cover is removed. The bomblet layer is brought over the projectile casing to be equipped. The suction manipulator, with the transport cover and the bomblet layer, is lowered to the projectile casing. The appropriately configured hydraulic feed device 50 picks up the bomblet layer that is released by the transport cover, so that the bomblet layer can be lowered into the projectile casing with the assistance of the hydraulic feed device. The next bomblet layer can then be supplied. The second projectile also has an uppermost and lowermost layer, the lowermost layer being the first which is loaded in. In a second projectile having only one layer of bomblets, that layer is both the uppermost and lowermost layer.

The dismantling and re-equipping steps are repeated until either the last bomblet layer has been removed from the first projectile or until an uppermost bomblet later has been introduced into the second projectile.

To finalize the assembly, the last bomblet layer is provided with metal cups, the bottom cover is placed onto the projectile, the ogive is screwed on, the ejector charge is introduced and the mouth closure screw is screwed in. The above-described preparations, of course, may be applied in order to disassemble a second projectile.

It is possible that detached bomblets must be ultimately disposed of if their reuse in other projectiles is not required. Accordingly, an aspect of the invention provides for dismantling an individual bomblet so that it may be safely disposed of.

Figure 4:
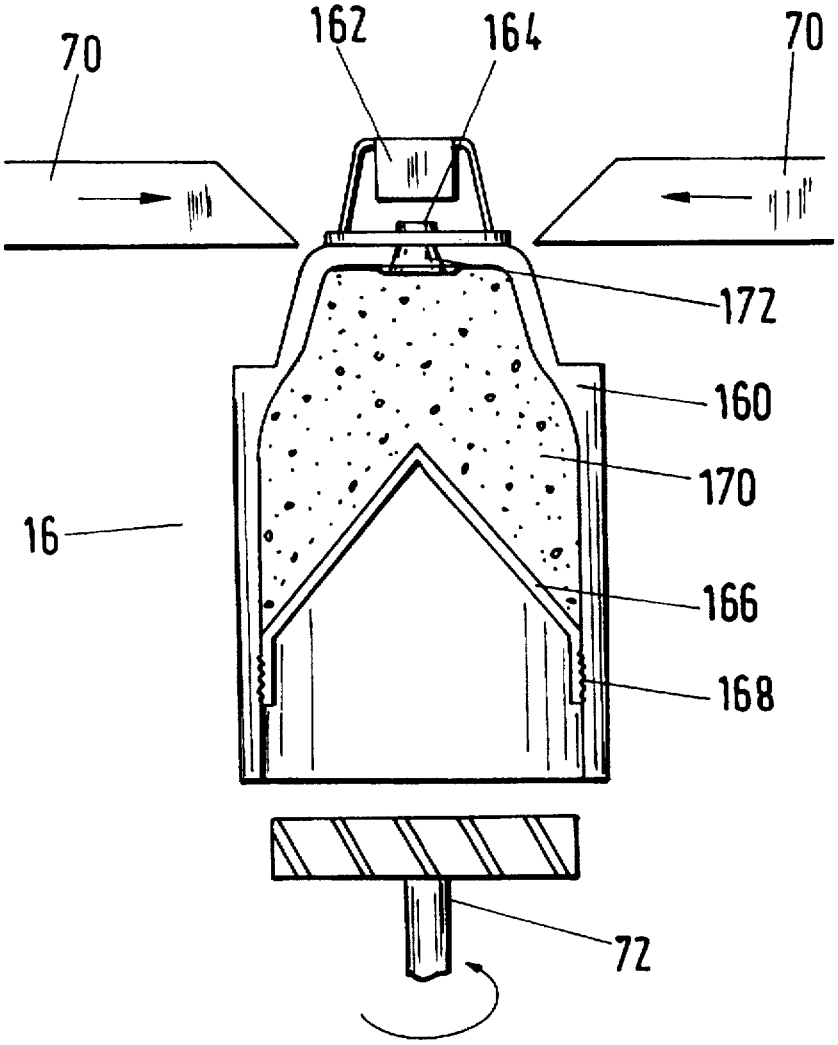
FIG. 4 is an elevation of an apparatus for dismantling extra bomblets which are not needed for reassembly so that the extra bomblets may be safely disposed of, the bomblet being shown in section.

The corresponding work steps are shown in FIG. 4. A detonator housing 162 of the bomblet 16 is broken off with the assistance of a force-actuated chisel 70. A bead location 168 lying at the bomblet housing 160 is then milled out with the assistance of a hob 72, so that a beehive funnel 166 can be removed. An explosive 170 is now exposed and may be removed with a profiling cutter (not shown in FIG. 4). An expressing tool (likewise not shown), ejects an ignition intensifier 172. An interior of the remaining housing 160 is then washed out. The explosives of the bomblet, namely explosive 170, ignition intensifier 172 and detonator, are subsequently burned in a safe manner, such as in a rotary tubular kiln. The housing can then be disposed of in a standard way.

The disclosed method enables a non-hazardous disassembling of armed bomblets and the reassembling of those bomblets into projectiles with different calibers. The method further provides the non-hazardous disposal of bomblets which are no longer required. The overall operation may be performed by a robot for protecting workers undertaking the disassembling and re-equipping.

Various changes and modifications to the presently preferred embodiments will be apparent to those skilled in the art. Such changes and modifications may be made without departing from the spirit and scope of the invention, and without diminishing its attendant advantages. Accordingly, the appended claims are intended to cover such changes and modifications.

What is claimed is:

1. A method for removing a plurality of bomblets disposed in one or more layers in a first projectile, each layer arranged in a first positional pattern, and for loading at least some of the bomblets into a second projectile in one or more layers, each layer arranged in a second positional pattern, the method comprising the steps of:

a) seating a bomblet layer of the first projectile against a first transport cover having a plurality of recesses arranged to align with;

b) applying a vacuum to the bomblet layer to pneumatically hold the bomblet layer to the first transport cover;

c) lifting the bomblet layer from the first projectile;

d) placing a bottom cover under the bomblet layer of the first projectile and detachably securing the bottom cover to the first transport cover;

e) transporting the bomblet layer away from the first projectile;

f) removing the individual bomblets from the first transport cover;

g) pneumatically holding at least some of the bomblets on a second transport cover having a plurality of recesses arranged to align with the second positional pattern;

h) lowering the bomblets pneumatically held by the second transport cover into the projectile casing of the second projectile; and i) repeating steps a) through h) until either a lowermost bomblet layer is removed from the first projectile or an uppermost bomblet layer is introduced into the second projectile.

2. The method according to claim 1, wherein the first projectile has a first caliber and the second projectile has a second caliber different than the first caliber.

3. The method according to claim 1, further comprising: temporarily disabling a fuse of each bomblet after each step d).

4. The method according to claim 1, further comprising:

determining whether a fuse of each of the bomblets is secured before each step a).

5. The method according to claim 1, wherein the bomblet layers are pneumatically held to the first or second transport cover by a vacuum applied through the transport cover.

6. The method according to claim 5, further comprising:

providing an opening for each bomblet communicating with each of the plurality of recesses in each of the first and second transport covers.

7. The method according to claim 6, further comprising:

inserting respective safety pins through each opening in the respective transport cover to disarm the respective fuses.

8. The method according to claim 1, further comprising:

turning the transport cover by 180° after step c).

9. The method according to claim 1, further comprising:

disposing of at least some of the bomblets not lowered into the second projectile.

10. The method according to claim 9, further comprising, for each bomblet to be disposed of:

breaking off a trigger housing that activates a respective detonator of the bomblet;

milling out a bead location which fixes a beehive funnel;

removing an explosive;

ejecting an ignition intensifier;

washing out a housing of the bomblet; and burning the explosive, ignition intensifier and detonator.

11. An apparatus for disassembling or reassembling a plurality of bomblets disposed in one or more layers in a projectile, whereby bomblets arranged in a first positional pattern are disassembled from a first projectile of a first caliber and are reassembled into a second projectile with a second caliber and arranged in a second positional pattern, the apparatus comprising:

at least one first transport cover having a seating region with a plurality of bomblet recesses conforming to the first positional pattern and adapted to seat against a bomblet layer arranged in the first positional pattern;

at least one second transport cover having a seating region with a plurality of bomblet recesses conforming to the second positional pattern and adapted to seat against a bomblet layer arranged in the second positional pattern;

a feed device for raising the one or more layers of bomblets from the first projectile and a feed device for lowering the one or more layers of bomblets into the second projectile;

at least one first bottom cover that is detachably secureable to the first transport cover such that the bomblet layer is firmly held between the first transport cover and the first bottom cover;

at least one second bottom cover that is detachably securable to the second transport cover such that the bomblet layer is firmly held between the second transport cover and the second bottom cover; and a pneumatic device for holding a bomblet layer against the first and second transport cover via a vacuum applied through the respective transport cover.

12. The apparatus according to claim 11, wherein the at least one first and second transport covers include openings through which a vacuum can be applied to the seating region of each.

13. The apparatus according to claim 12, wherein each of the nesting recesses has a seating edge which is seatable against the respective bomblet in a sealed manner, whereby one of the openings is in fluid communication with each nesting recess.

14. The apparatus according to claim 12, wherein each bomblet includes a fuse and a means for disabling the fuse and wherein the openings are arranged such that a safety pin for disabling the fuse of the respective bomblet is insertable through each respective opening.

15. The method according to claim 1, wherein the first positional pattern is different from the second positional pattern.

16. The apparatus according to claim 11, wherein the first positional pattern is different than the second positional pattern.

* * * * *